United States Patent [19]

Falk et al.

[11] 4,007,617

[45] Feb. 15, 1977

[54] METHOD OF ROLLING METAL BLANKS

[75] Inventors: Curt Gunnar Falk, Stockholm; Per-Olof Strandell, Taby; Per Erik Albrecht, Bromma; Goran Anders Wallner, Hagfors, all of Sweden

[73] Assignee: AB Metalform, Stockholm, Sweden

[22] Filed: Oct. 17, 1975

[21] Appl. No.: 623,507

[30] Foreign Application Priority Data

Sept. 23, 1975 United Kingdom ..... 38910

[52] U.S. Cl. ..... 72/234; 72/366

[51] Int. Cl.[2] ..... B21B 1/12

[58] Field of Search ..... 72/234, 235, 199, 226, 72/366

[56] References Cited

UNITED STATES PATENTS

| | | | |
|---|---|---|---|
| 1,650,607 | 11/1927 | Cook | 72/235 |
| 3,600,924 | 8/1971 | Martin | 72/234 |
| 3,683,662 | 8/1972 | Dechene et al. | 72/235 |
| 3,729,973 | 5/1973 | Wykes | 72/234 |
| 3,848,447 | 11/1974 | Strandell | 72/199 |

OTHER PUBLICATIONS

"Developing Wire Rod Manufacture" by Weber, Reprinted from The Wire Industry, Feb., 1968.

*Primary Examiner*—Milton S. Mehr
*Attorney, Agent, or Firm*—Stevens, Davis, Miller & Mosher

[57] ABSTRACT

Rod or wire shaped material is produced by substantial reduction of the cross-sectional area of a metal blank in each of two types of alternating, sequentially arranged rolling passes, each of one type of pass being effected by flat-rolling the blank in at least one pair of rolls having substantially smooth roll barrels, and each of the other type of pass being effected by upset-rolling the blank in at least one pair of rolls having grooves which exhibit a rounded groove bottom.

7 Claims, 7 Drawing Figures

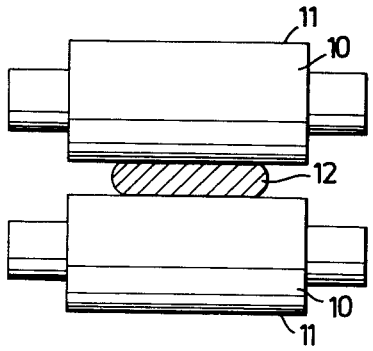
Fig. 1
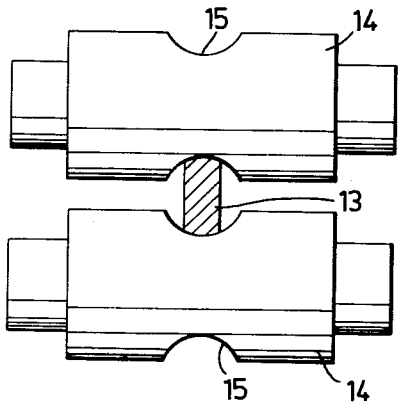
Fig. 2
Fig. 3
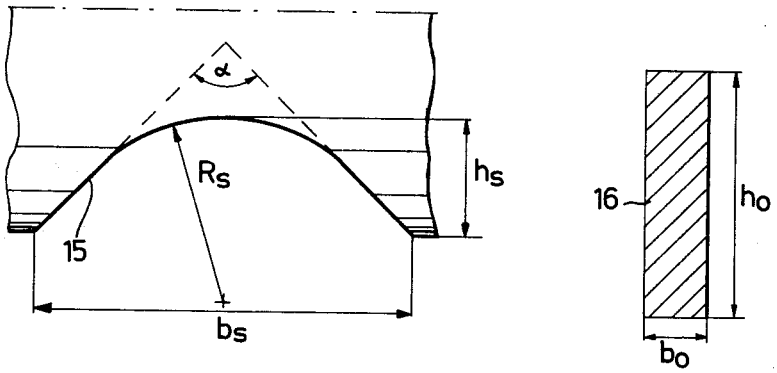

METHOD OF ROLLING METAL BLANKS

The present invention relates to the production of rod or wire shaped material by reduction of metal blanks by rolling in a plurality of passes and in particular to the reduction of steel blanks.

A plurality of different pass series have been proposed for the reduction of metal blanks, which blanks may have been produced, for example, by reducing blooms or, billets according to conventional rolling techniques in so-called bull-heads and in box-groove rolls, or by continuous casting processes, optionally followed by a reduction of the cast blank in a rough-rolling mill.

One disadvantage inherent with the prior art pass series is thus that the ingoing and outgoing dimensions of the blank with respect to a specific groove can only be varied to a small degree, i.e. the flexibility of the series is low, which, for example, often means that the grooves must be changed when production is changed from the rolling of carbon steel blanks to the rolling of stainless steel blanks, since stainless steel spreads more and would otherwise give rise to the formation of fins, which would be subsequently rolled into the blank.

In many rolling mills it is normal to work to a very large extent with small batches which differ widely with regard to their quality and dimensions. Since each material is deformed differently between the rolls and since a specific series of passes is adapted to certain dimensions and qualities, this means that the waiting times experienced in the rolling mill for the change of pass series are quite considerable. In practice, attempts have been made to aleviate this disadvantage by dividing the blanks to be rolled into groups of similar deformation characteristics. To each such group there is then assigned a basic pass series by means of which it is attempted to produce as many different finished dimensions as possible. By planning the production, it is then attempted to minimise the number of stops needed for the exchange of pass series. A desirable development is thus one in which a pass series is provided by means of which the whole of the programme with regard to quality and dimensions of a rolled blank can be achieved without changing the grooves, and in which the dimensions of the blanks can be varied by changing the clearance between the rolls.

The object of the present invention is to provide a novel and useful method of reducing metal blanks by rolling, in which the aforementioned disadvantages associated with conventional pass series are at least substantially eliminated, and which therefore provides superior flexibility. A particular object of the invention is to provide a pass series which can be used to particular advantage when hot-rolling steel blanks to rod and wire material having a diameter in the range of 5 to 80 mm.

To this end there is proposed in accordance with the invention a method in which a metal blank is reduced by rolling in a plurality of passes, said method being substantially characterised in that the blank is reduced successively through two types of alternating, sequentially arranged passes, each of one type of pass being effected by flat-rolling the blank to a width-height ratio of 2:6 in at least one pair of rolls having a substantially smooth roll barrel, and each of the other type of pass being effected by upset-rolling of the blank to a height-width ratio of 1.5 – 3.5 in at least one pair of rolls having open grooves which exhibit a rounded groove bottom and a width of 1.5 – 3.5 times the width of the blank to be upset-rolled. The method according to the invention can be effected by reversible rolling, at least provided that the blank has a moderate length, although said method is preferably effected completely, or to a large extent, by continuous rolling. The method according to the invention affords a very high degree of selectivity with regard to the clearance between the rolls, and therewith a high degree of flexibility. Owing to the fact that the pass series according to the invention exhibit repeated passes in which the blank is rolled between smooth roll barrels, the ingoing and outgoing dimensions of the blank can be varied within wide limits without the risk of fin formation. The dimensions of the blank can also be greatly varied in the upsetting passes which follow the flatrolling passes without the risk of fin formation. By suitable selection of the form of the grooves in the upsetting rolls, the cross sectional area of the ingoing blank can be varied in the ratio of 4:1. In present-day pass series, this ratio does not exceed 1.2:1.

The pass series also provides an extremely uniform and homogeneous deformation of the blank over its cross-section, which is of particular significance when rolling steel having a high carbon content where a uniform decarburised outer surface zone is desired. In this respect, conventional pass series leave much to be desired. The method according to the invention thus subjects the material to less strain, which means that edge cracks can readily be avoided.

Since the rolls normally have a hardness reaching 600 Brinell the task of cutting grooves in the rolls is both time-consuming and expensive. This disadvantage is reduced with the pass series according to the invention, owing to the presence of roll pairs having smooth roll barrels.

Since the blank is given a substantially rectangular cross-sectional shape in both the flat-rolling and upset-rolling passes, the entry guides for both the flat and upset-rolling operations can be of relatively simple construction.

In the flat-rolling operation the blank section is suitably rolled flat to a width-height ratio of 3.5 – 5, an area reduction of over 50% normally being taken, which is totally unique. With present-day pass series, for example the square-oval passes which are considered as hard reducing passes, reductions of up to 35% are seldom achieved.

When rolling is effected on a blank section having a width which is less than approximately twice the height or thickness of said section, it is convenient to divide the flat-rolling operation into two passes so that the total widening when rolling the section is reduced, and therewith also the energy consumption. The blank section is rolled in a first flat-rolling step suitably to a width-height ratio of approximately 2.5 – 3 and then in a subsequent flat-rolling step. In this latter step the blank is widened to only a small extent owing to the relatively high width-height ratio of the blank.

In the subsequent upset pass or passes, the blank is rolled preferably from a height-width ratio of between 3.5 and 5, to a more shallow rectangle having a height-width ratio of between 1.5 and 3.5. Literature on this art discloses that it is impossible to upset a section having a higher height-width ratio than 3.5, since otherwise the section would tilt at greater reductions. Greater height-width ratios are fully possible, however, with the method according to the invention provided that the roll diameter is correctly adjusted to the height of the section. A suitable roll diameter-height ratio is obtained when there are used upsetting rolls having a diameter which is at most ten times the height of the blank section, preferably 4 – 8 times the height of said section. When the height of the blank section exceeds approximately 4.5 times the width of the section, it is convenient for the blank to be rolled in a first upset-rolling step to a height-width ratio of 4.5, so that the blank does not collapse, and thereafter to roll the blank in a further upset-rolling step to the desired measurements.

When upset-rolling to a height-width ratio of less than 1.2, it is convenient, from the point of view of stability, for the subsequent flat-rolling operation to be effected from the same sides of the blank section as the preceding upset-rolling step. Such a rolling sequence also provides extremely high reductions in area.

A particularly stable guiding of the blank in the upsetting passes is obtained when the form of the grooves used for the upset rolling lies within the following parameter limits:

$$\frac{h_s}{h_o} = 0.05 - 0.4$$

$$\frac{b_s}{b_o} = 1.5 - 3.5$$

$$\alpha = 50 - 140°$$

$$\frac{R_s}{b_o} = 0.75 - 3.0$$

where $h_o$ is the ingoing height of the blank, $b_o$ is the ingoing width of the blank, $h_s$ is the depth of the groove, $b_s$ is the width of the groove, $\alpha$ is the angle between the groove flanks and $R_s$ is the radius of the groove bottom.

The method according to the invention is illustrated diagrammatically in the accompanying drawing. FIG. 1 shows a typical flat-rolling pass and FIG. 2 a typical upset-rolling pass, the height of the blank and the depth of the grooves being exaggerated for the sake of simplicity. FIG. 3 shows a suitable form for the grooves used for the upset-rolling step and a blank section, in smaller scale, which shall be upset in said groove. FIGS. 4 – 7 show sequences of preferred series of passes according to the invention.

In FIG. 1, which illustrates a flat-rolling pass used in the method according to the invention, there is shown the rollers 10 having substantially smooth roll barrels 11. Normally the roll barrel 11 is cylindrical, although it lies within the scope of the invention to provide a slightly concave roll barrel so as to inhibit the spread of the blank during a flat-rolling step. The blank undergoing a flat-rolling operation is referenced 12.

In FIG. 2, which illustrates an upset-rolling pass used in the method according to the invention, the blank being rolled is referenced 13, the rolls 14 and the roll grooves 15.

FIG. 3 shows, in larger scale, a suitable embodiment of the grooves 15 shown in FIG. 2, and in smaller scale a blank section 16 which is to be upset-rolled in the groove 15. In this respect, the groove 15 should have a depth $h_s$, which is 0.05 – 0.4 times the height $h_o$ of the section 16, a width $b_s$, which is 1.5 – 3.5 times the width $b_o$ of the section 16, and a groove-bottom radius $R_s$, which is 0.75 – 3.0 times the width $b_o$ of the section 16, and exhibits an angle $\alpha$ between the groove flanks which is 50° – 140°.

FIG. 4 shows a pass sequence which, from the point of view of the energy consumed, is extremely advantageous, since the blank is widened only to a small extent. Calculated from the starting blank 17, the pass sequence comprises the following steps: upset pass — upset pass — flat-roll pass — flat-roll pass. The roll pairs (not shown) used for the pass series thus have the following positions of array: horizontal — horizontal — vertical — vertical — horizontal — horizontal, etc. The references H and B indicate here and in FIGS. 5–7 the height and width respectively of the blank section and the height-width ratio is given under each blank section in FIGS. 4–7.

FIG. 5 shows a hard reduction pass sequence, in which the flat-rolling step is effected from the same sides as the upset-rolling step. Calculated from the starting blank 18, the pass sequence comprises: upset pass — flat-roll pass. A suitable array for the roll pairs for the pass series is thus: horizontal — horizontal (rotation of the blank through 90°) — horizontal — horizontal (rotation of the blank through 90°) etc.

Figure 4:
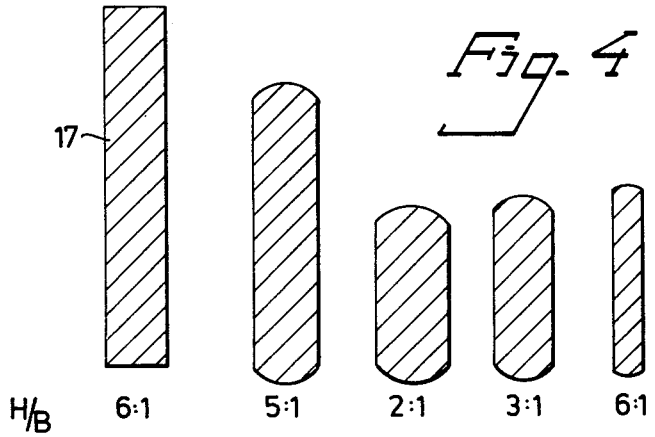
Figure 5:
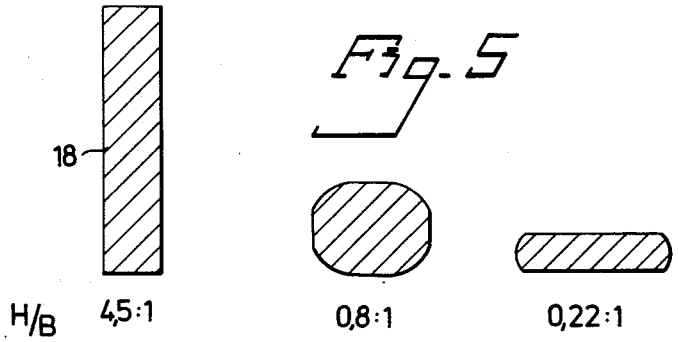
Figure 6:
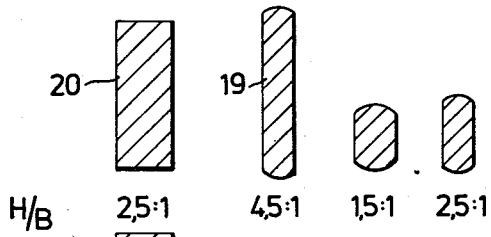
FIG. 6 shows a pass sequence in which the blank 19 is guided during the upset pass carried out in a horizontal roll pair (not shown) by vertical roll pairs (now shown) located on either side of the pass. Calculated from the starting blank 20, the pass series comprises: flat-roll pass — upset pass — flat-roll pass etc.
Figure 7:
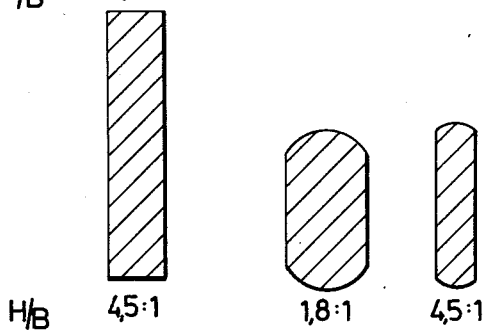
FIG. 7 shows a sequence of a pass series according to the invention in which the roll pairs (not shown) are arranged in a repeated horizontal — vertical arrangement, which can often provide the least expensive rolling mill equipment.

The invention is not restricted to the embodiments illustrated in the drawing. Thus, a pass series according to the invention may comprise mutually different pass sequences, for example sequences according to two or more of FIGS. 4 – 7, and the final form of the blank rolled in accordance with the invention can be imparted to the blank in a grooved roll pair particularly designed therefor and arranged immediately adjacent the last roll pair in the pass series according to the invention. Such a final roll pair may, for example, be provided with round grooves or square grooves, and said roll pair may be driven with or without clearance between the rolls, depending upon the desired final section of the blank.

We claim:

1. A method of reducing a metal blank by rolling in a plurality of passes, comprising rolling the blank successively through two types of alternating, sequentially arranged passes, of which passes each of one type of pass comprises flat-rolling said blank to a width-height ratio of 2 – 6 in at least one pair of rolls having substantially smooth roll barrels, and each of the other type of pass comprises upset-rolling said blank to a height-width ratio of 1.5 – 3.5 in at least one pair of rolls having open grooves exhibiting a rounded groove bottom and a width of 1.5 – 3.5 times the width of the blank to be upset-rolled.

2. A method according to claim 1, in which the flat-rolling step is effected on a blank section having a width which is less than approximately twice the height of the blank section, wherein the blank section in a first flat-rolling step is reduced to a width-height ratio of approximately 2.5 – 3 and is then reduced further in a subsequent flat-rolling step.

3. A method according to claim 1, wherein the blank section is flat-rolled to a width-height ratio of 2 – 6, preferably 3.5 – 5.

4. A method according to claim 1, in which the upset-rolling step is effected on a blank section having a height exceeding approximately 4.5 times the width of the blank section, wherein the blank section in a first upset-rolling step is reduced to a height-width ratio of approximately 4.5 and is then reduced further in a subsequent upset-rolling step.

5. A method according to claim 1, in which the upset-rolling step is effected on a blank section having a height exceeding approximately 4.5 times the width of the blank section, wherein there is used upset rolls having a diameter which is at most ten times the height of the blank section, preferably 4 – 8 times the height of said section.

6. A method according to claim 5, wherein there is used upset rolls having a diameter of 4 – 8 times the height of said section.

7. A method according to claim 1, wherein for the upset-rolling step there is used a groove whose depth is 0.05 – 0.4 times the height of the blank section, whose bottom radius is 0.75 – 3.0 times the width of the blank section, and the groove flanks of which subtend an angle of 50°– 140° therebetween.

* * * * *